United States Patent [19]

Pirkle

[11] Patent Number: 4,848,389

[45] Date of Patent: Jul. 18, 1989

[54] FREEZE PROTECTION DEVICE

[76] Inventor: Fred L. Pirkle, Box 27, Oreland, Pa. 19075

[21] Appl. No.: 295,107

[22] Filed: Jan. 6, 1989

Related U.S. Application Data

[62] Division of Ser. No. 194,164, May 16, 1988.

[51] Int. Cl.[4] ..... F16K 17/38

[52] U.S. Cl. ..... 137/80; 137/62; 137/79; 137/357; 137/468

[58] Field of Search ..... 137/62, 13, 79, 80, 137/357, 468; 251/11

[56] References Cited

U.S. PATENT DOCUMENTS

| | | | |
|---|---|---|---|
| 1,526,718 | 2/1925 | Opp | 137/79 |
| 3,369,556 | 2/1968 | Allderdice | 137/79 |
| 3,812,872 | 5/1974 | Block et al. | 137/62 |
| 4,133,338 | 1/1979 | Honikman | 137/62 |
| 4,460,007 | 7/1984 | Pirkle | 137/62 |
| 4,730,637 | 3/1988 | White | 137/468 |

*Primary Examiner*—A. Michael Chambers

*Attorney, Agent, or Firm*—Howson & Howson

[57] ABSTRACT

For freeze protection of a water line, a T fitting in the line is provided with a removable threaded bushing having a plug with radially projecting balls which engage J-shaped slots in the bushing to provide a bayonet joint. The plug is released when freezing conditions threaten by retraction of the balls in response to movement of a cam inside the plug by a thermal actuator also inside the plug.

A check valve in the T fitting is closed automatically when the threaded bushing is removed.

Modified versions include a plug having dual actuators in series, a plug combined with a flanged bushing for use in freeze protection of a compressor head, a plug combined with a valve to provide a snap-action drain valve with a more easily replaceable actuator assembly, and a plug using a water-filled glass vial as an actuator. A building protection system and a locomotive coolant system both use freeze protection devices in accordance with the invention.

2 Claims, 10 Drawing Sheets

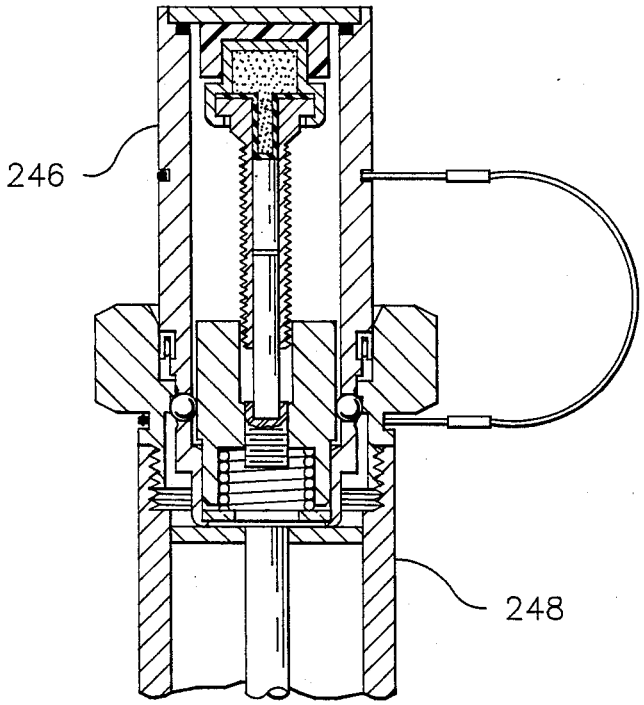
FIG 11
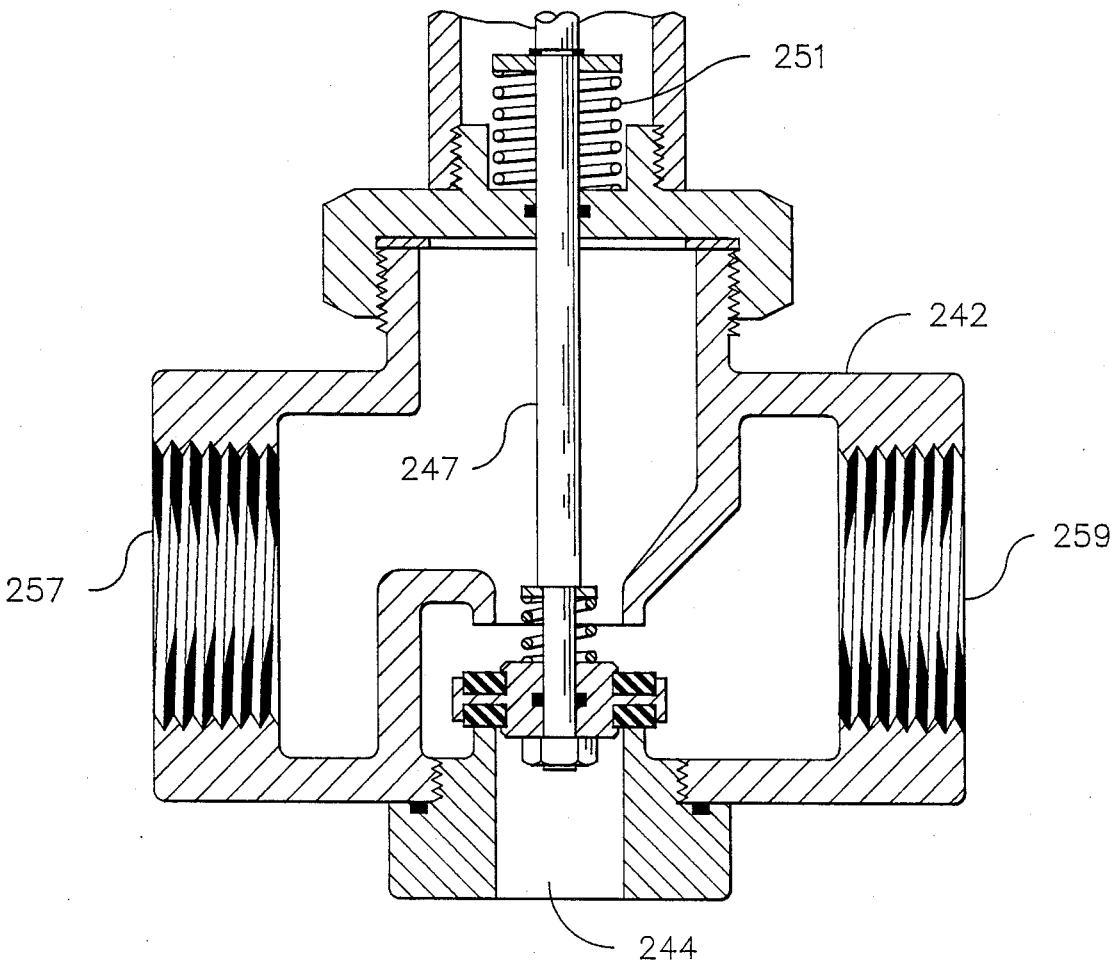

FREEZE PROTECTION DEVICE

CROSS REFERENCE TO RELATED APPLICATION

This is a division of my copending application Ser. No. 194,164, filed May 16, 1988.

BRIEF SUMMARY OF THE INVENTION

This invention relates to the protection of water-containing systems from damage due to freezing, and in particular to a temperature-sensitive device which releases water from the system when the temperature of the water, or the ambient temperature, fall below a predetermined limit.

The invention has utility in numerous applications such as the protection of water supply and heating and cooling systems in buildings, cooling water systems of railroad locomotives, compressor sets and heavy equipment, water systems of shipboard and land-based power plants, dock lines, irrigation equipment, fire-extinguishing sprinkler systems, condensate removal systems, and process water systems.

In general, the objective of a freeze protection device is to cause a water-containing system to be drained automatically when freezing conditions are threatened, so that the expansion which takes place as the water freezes does not damage pipes and other components.

The simplest method of freeze protection, of course, is to use anti-freeze. This eliminates the need for freeze-protection devices altogether. However, anti-freeze is expensive and has limited applicability. It is generally unusable, except where the water is to be used exclusively as a coolant. It is impractical, even in coolant systems, where large volumes of water are required. In railroad locomotives, for example, anti-freeze is not ordinarily used. Instead, temperature-sensitive drain valves are used. This is practical because a locomotive is usually in operation continuously over long periods of time, and encounters a threat of freeze damage only infrequently.

The most commonly used freeze protection devices are freeze plugs and temperature-responsive valves.

A freeze plug is simply a plug which is force-fit into an opening of a water-containing system. When the water in the system begins to freeze, expansion of the water applies a tremendous pressure to the plug, forcing it out of its opening. Ideally, this relieves the pressure in the system and allows the system to drain partially, thereby preventing damage to the system components. One of the drawbacks of the freeze plug is that it operates only after freezing occurs. If other parts of the system, remote from the freeze plug, are colder, they may freeze before freezing occurs at the plug location. If this happens, blockage may occur which prevents draining of the system when the freeze plug operates. Serious damage can result, even though freeze plugs are present in the system. Thus, it is usually necessary to provide multiple freeze plugs in a system. It is also important to locate freeze plugs not only where they will allow the system to drain, but also where initial freezing is apt to occur in the system. Often this is impossible to achieve. Consequently, freeze plugs, although able to reduce freeze damage, are rarely able to eliminate it. Another drawback of the freeze plug is that it requires special tools for its installation and it normally cannot be readily and easily replaced.

A more practical alternative to the conventional freeze plug is the temperature-responsive valve. A typical temperature-responsive valve uses a thermal actuator to sense water temperature, ambient temperature or both, and opens to drain the water-containing system before the water begins to freeze. The thermal actuator can be, for example, a bellows, a bimetallic element controlling an electric solenoid, or, more commonly, a wax-filled thermal actuator. There are two basic types of temperature-responsive valves in common use: the "modulating" valve, which opens to varying degrees depending on the temperature sensed by its actuator, and the "snap-action" valve, which snaps open and stays open to drain a system completely when the sensed temperature falls below a predetermined limit. An example of a popular snap-action valve, used extensively in railroad locomotives, is described in my U.S. Pat. No. 4,460,007, dated July 7, 1984.

Temperature-responsive valves are superior to conventional freeze plugs because they can be set to open at temperatures slightly above freezing and because they can be positioned and operated in such a way as to drain water from the protected system substantially completely. However, they are more expensive. Furthermore, they must be rebuilt or replaced periodically to insure reliable operation. Special tools are ordinarily required to remove and replace temperature-responsive valves. In cold weather, it is necessary in many cases to apply heat to a valve to reset it to its closed condition. In railroads heat for resetting is often applied by means of a fusee, at considerable expense, and with great danger and difficulty due to the presence of diesel fuel and the fact that the freeze-protection valves are often at nearly inaccessible locations underneath the locomotive. One solution to the resetting problem is to use a remote control resetting device. Another solution to use a disposable latch which holds the valve closed until the system temperature rises above freezing and then automatically falls away. These solutions are described in my U.S. Pat. No. 4,438,777, dated Mar. 27, 1984. The principal difficulty with the remote control is that it adds to the expense and complexity of the valve. The principal difficulty with the disposable latch is that it is necessary to maintain a supply of latches on hand. Another problem inherent in the use of temperature-responsive valves is that it has not been possible to replace these valves for preventive maintenance without draining water from the system.

One of the objects of the invention is to overcome the above-mentioned disadvantages of conventional freeze plugs and temperature-responsive freeze protection valves by means of a simple, reliable and inexpensive device. Other objects of the invention include the provision of a freeze protection device in which substantially all of the working parts are contained in a simple, easily replaced unit, the provision of a more versatile freeze protection device, the improvement of the reliability of freeze protection devices which depend on wax-filled thermal actuators, and also improvement in reliability by the elimination of wax-filled thermal actuators in favor of a superior temperature-sensitive actuator.

The freeze-protection device in accordance with the invention comprises a T fitting or similar device for providing a drain opening in a liquid system, and a plug insertable into the drain opening for blocking flow of liquid outwardly through the drain opening. The plug includes a latch, movable between a released condition and an engaged condition. The latch is normally in its engaged condition and maintains the plug in its inserted condition in the drain opening. However, when the latch is moved to its released condition, it releases the plug from the drain opening. The latch preferably consists of radially movable balls operated by a cam located in the interior of the plug. The latch is operated by temperature-sensitive means carried by the plug, such as a wax-filled thermal actuator or a spring-loaded, water-filled glass vial, so that the latch is released when a predetermined temperature is reached.

When the latch is released, the plug falls or is pushed out of the drain opening, and allows the system to be drained of liquid. The plug is preferably attached to the T fitting by a lanyard so that it will not be lost. The plug can be easily removed from the lanyard, warmed at any convenient location to reset it (if it uses a wax-filled actuator) and replaced in the T fitting. If the plug uses a water-filled vial actuator, it can readily be replaced by a new or rebuilt plug. The spent plug can be recovered and returned for rebuilding.

Other objects and advantages of the invention will be apparent from the following detailed description when read in conjunction with the drawings.

BRIEF DESCRIPTION OF THE DRAWINGS

FIG. 11 is a vertical section of the outdoor freeze protection device shown in FIG. 8.

DETAILED DESCRIPTION

Figure 1:
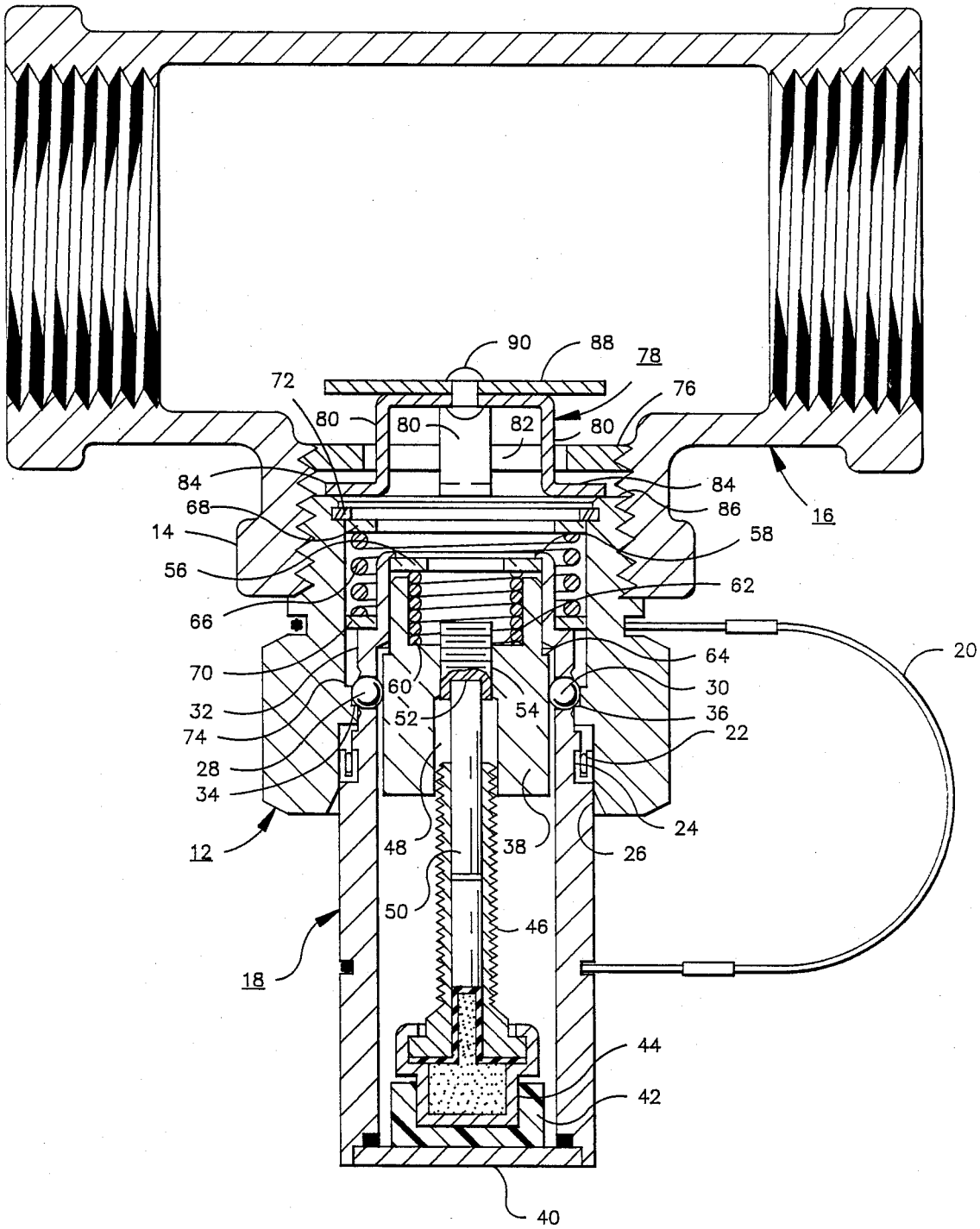
FIG. 1 is a vertical section of a freeze protection device in accordance with the invention in which the plug utilizes a single wax-filled thermal actuator and is shown engaged in a drain opening provided by a bushing threaded into the neck of a T fitting.

As shown in FIG. 1, the freeze protection device of the invention comprises, as its principal parts, a bushing and a plug. The bushing 12 is threaded into a neck 14 of a conventional T fitting 16 which forms part of a liquid system. A plug 18 extends into the bushing and is normally held in the position shown. However, the plug is removable from the bushing. A flexible lanyard 20, of stranded metal wire or plastic material, has a loop at one end connected to a groove in the bushing and a loop at its other end connected to a groove in the plug. The lanyard is of a length such that it allows the plug to disengage completely from the bushing. The loop of the lanyard which attaches to the plug 18 is of tear drop shape and is of a size such that, when it is manually brought to a circular condition, its inner diameter is slightly greater than the outer diameter of the plug. This allows the plug to be removed from the lanyard by deliberate manipulation, yet prevents inadvertent disengagement of the plug from the lanyard.

The plug 18 is provided with an annular seal 22, which is held in a groove 24 formed in the outer surface of the plug. The seal is a hydraulic energized, low break-out seal having an outer sealing lip which is urged radially outwardly by liquid pressure into tight engagement with the cylindrical inner wall 26 of bushing 12. The seal comprises a machined ring of PTFE having a U-shaped cross-section and narrow sealing lips. A metallic spring is provided between the inner and outer lips to maintain the lips in engagement with the cylindrical surfaces to be sealed, even when liquid pressure is not applied. A suitable low-breakout seal is manufactured by American Variseal of 510 Burbank St., P.O. Box 1479, Broomfield, Colo. 80020.

Balls 28 and 30 are two of a series of metal balls which extend outwardly through radial openings in the wall of the plug. The device shown uses four balls. However, as few as three balls, or larger numbers of balls can be used. The radial openings are staked, i.e. provided with swaged indentations, so that their outer ends are slightly smaller in diameter than the balls and the balls are held captive but are nevertheless able to protrude beyond the cylindrical outer surface 32 of the plug to engage ledges 34 and 36 respectively, which are formed on the inner wall of bushing 12. The balls are maintained in the outwardly protruding condition depicted in FIG. 1 by cam 38, which is axially slidable in the interior of the plug.

The lower end of plug 18 is closed by a disc 40, which is held in place by a force fit and sealed by means of an O-ring. The disc carries a seat 42, which holds a wax-filled thermal actuator 44. Seat 42 can be made of a suitable insulating material, such as a foamed polymer, to isolate the actuator partly from ambient temperatures. Alternatively, the seat can be thermally conductive so that the actuator is partially responsive to outside temperatures. The actuator stem 46 extends upwardly into a space 48 within the interior of cam 38. The actuator piston 50 extends from the upper end of stem 46, through space 48, and is received in a recess 52 of an adjusting screw 54, which is threaded into the cam and accessible through an opening in a spring retaining washer 56. Washer 56 is held in the upper end of plug 18 by a small retaining flange 58 formed at the upper end of the plug. A spring 60 is held in compression between the washer and the lower end 62 of a recess formed in the upper end of the cam. Spring 60 urges the cam downwardly against piston 50 of the actuator, so that, when the piston retracts as the temperature of the actuator falls, the cam moves downwardly.

A shoulder 64 is formed in the outer surface of the cam so that when the cam moves downwardly, the balls can move inwardly to clear the ledges of bushing 12 on which they rest, thereby allowing the plug to drop out of the bushing.

A coil spring 66 is held in compression between upper and lower retaining rings 68 and 70. Spring 66 is preferably designed to exert an axial force about four to five times the break-out force for seal 22. The lower retaining ring 70 rests on a shoulder of the plug, and preferably fits tightly between the plug and the inner wall of bushing 12 so that it serves as a trash seal, preventing solid matter in the freeze-protected water system from reaching the balls which hold the plug in place. The upper ring 68 is held against upward movement by snap ring 72, which fits into a groove in the inner wall of bushing 12 near its upper end. Spring 66 is held captive in bushing 12 because its upper retaining ring 68 is held by the snap ring 72, and downward movement of its lower retaining ring 70 is limited by shoulder 74 formed in the inner wall of the bushing just above the level of ball-retaining ledges 34 and 36. Ring 68 serves not only as retaining ring for spring 66, but also to provide a flow-restricting orifice, the size of which can be chosen for reduced flow or for any desired flow coefficient $C_v$. Flow restriction is necessary when the freeze protection device is used on a pipe system which cannot be completely drained, for example a water main on a dock or in a roadway tunnel. The flow-restricting orifice can be chosen to permit just enough flow to prevent freezing.

A ring 76 is threaded into neck 14 of the T fitting above, and spaced from, the upper end of bushing 12. A four-legged spider 78 has legs 80, which extend through opening 82 in ring 76 and feet 84, which extend outwardly from the lower ends of the legs so that the spider is supported on the upper end 86 of the bushing. A disc 88 is secured to the spider by a rivet 90. This disc is larger in diameter than opening 82 of ring 76, and can be made of metal or of a relatively rigid polymer. It serves as a closure to prevent escape of water from the protected system when the bushing is removed from the T fitting. The disc and spider assembly are actuated both by gravity and by the outward flow of water when the bushing is removed. A spring (not shown), urging the disc toward the opening in ring 76 can be provided, and is desirable when the protective plug assembly extends in a direction other than directly downward.

Figure 2:
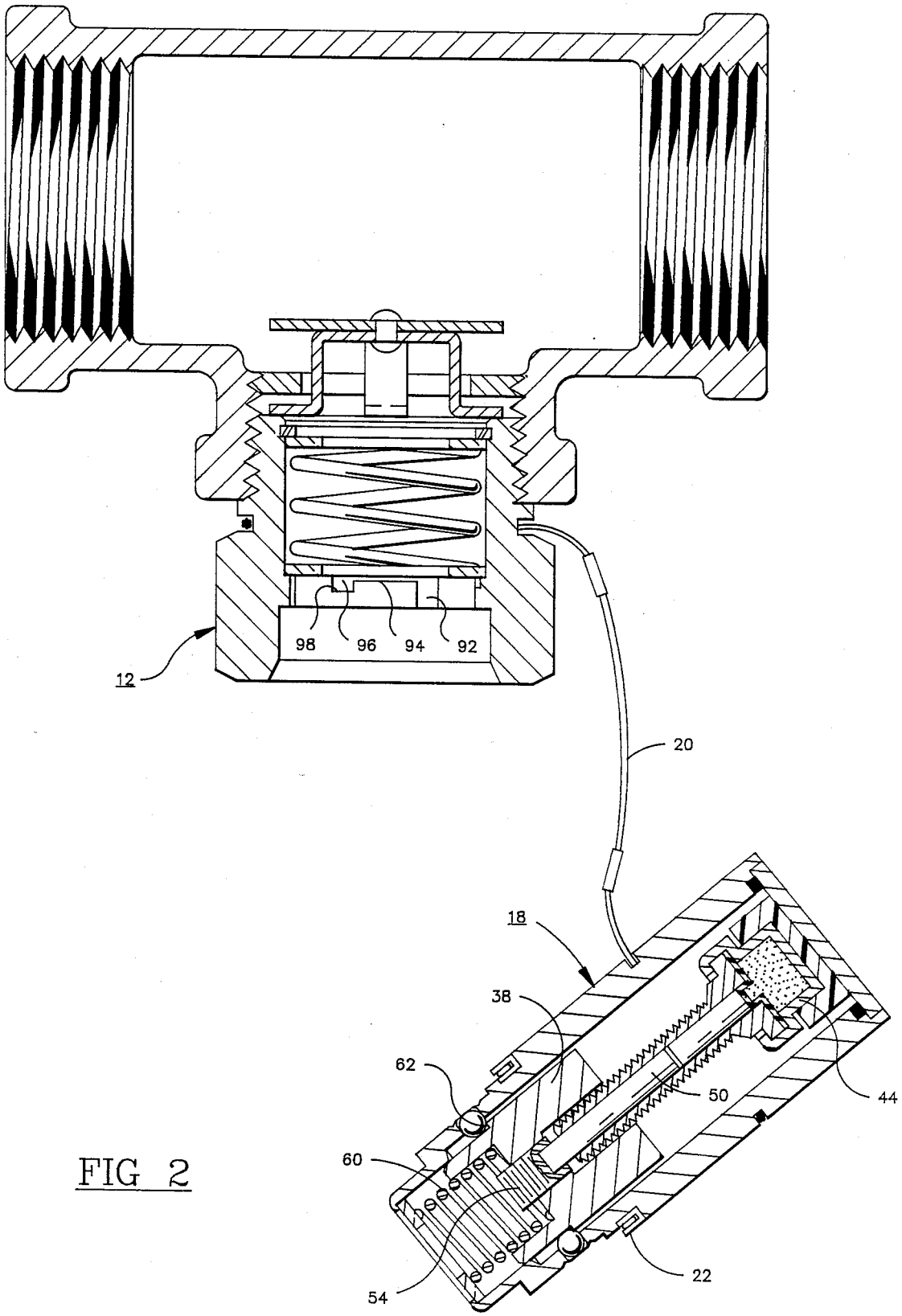
FIG. 2 is a vertical section of the freeze protection device of FIG. 1 in which the plug is disengaged from the drain opening.

One detail not seen in FIG. 1, but shown in FIG. 2, is the series of inverted J-shaped grooves formed in the inner wall of the bushing, which cooperate with the balls protruding from the plug 18 to provide a bayonet coupling allowing the plug to be quickly engaged in the bushing without the need for any tools. One such J-shaped groove is provided for each ball, and one groove is shown in FIG. 2. The groove comprises a vertically extending entry portion 92, a horizontally extending transition portion 94, and a downwardly extending end portion 96, having a ledge 98 (corresponding to ledges 34 and 36 of FIG. 1).

The plug is installed in the bushing by pushing it inwardly through the opening of the bushing and pressing it against ring 70 to compress coil spring 66. The latching balls are held in their protruding condition by the cam when the plug is installed, and enter the vertical entry portions 92 of the J-shaped grooves. The plug is then twisted so that the latching balls travel along the horizontal transition portions 94 and enter downwardly extending end portions 96. Coil spring 66 is then allowed to press downwardly against the plug to hold the balls in the end portions of the J-shaped grooves, against the ledges, including ledges 34, 36 and 98. Under cold ambient conditions, the plug may be warmed before insertion to insure that the latching balls are held by the cam in the protruding condition. Warming can easily be accomplished by any convenient means. For example, a worker can simply carry the plug in his pocket for a time to insure that it is sufficiently warm.

The plug connects to the bushing in bayonet fashion. Two motions are necessary to remove the plug manually. It must first be pushed upwardly. Then, it must be twisted to align the balls with the vertical entry portions of the J-shaped grooves. The use of an axially sliding seal such as seal 22 makes it possible to take advantage of the bayonet action of the J-shaped grooves. The coil spring 66, in combination with the J-shaped grooves, serves to prevent the plug from being accidentally disengaged from the bushing as a result of vibrations or other movements of the assembly. The plug can, however, be removed from the bushing easily for manual draining of the system.

The space within the plug surrounding the actuator fills with water from the line to which the T fitting is connected. Therefore, the actuator is responsive to water temperature. Because the interior of the plug fills with water from the line, freezing of the water within the plug will cause disc 40 to pop out if actuator 44 fails. Thus, disc 40 provides an added measure of protection against freeze damage.

FIG. 2 shows the plug 18 removed from bushing 12 and suspended by lanyard 20, after having been triggered by retraction of the thermal actuator piston. The retraction of the actuator piston allowed cam 38 to be pushed downwardly by spring 60 so that shoulder 62 of the cam cleared the balls, thereby allowing them to move inwardly to disengage the retaining shoulders of the bushing, including shoulders 34, 36 and 98. Preferably, the lanyard is secured to the plug at a location sufficiently remote from the open end of the plug that the plug hangs on the lanyard with its open end downward. This allows any water within the plug to drain and avoids damage to the plug itself as a result of freezing.

With the plug removed from the bushing as shown in FIG. 2, water in the system is allowed to flow out freely through the bushing to drain the system. Provided that the device is situated at the lowermost point in the system, and the relationship between the cam and the actuator piston is adjusted by screw 54 so that triggering takes place before freezing occurs in the system, the entire system can be drained by a single device. In some cases, however, it is desirable to use several freeze protection devices.

Figure 3:
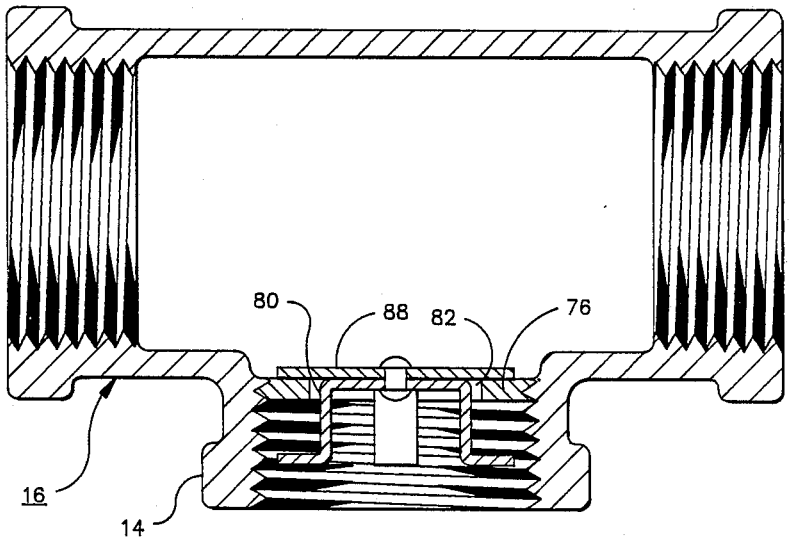
FIG. 3 is a vertical section of the freeze protection device of FIGS. 1 and 2 in which the plug is in the set condition and engaged with the bushing, but in which the bushing is disengaged from the neck of the T fitting.
Figure 3:
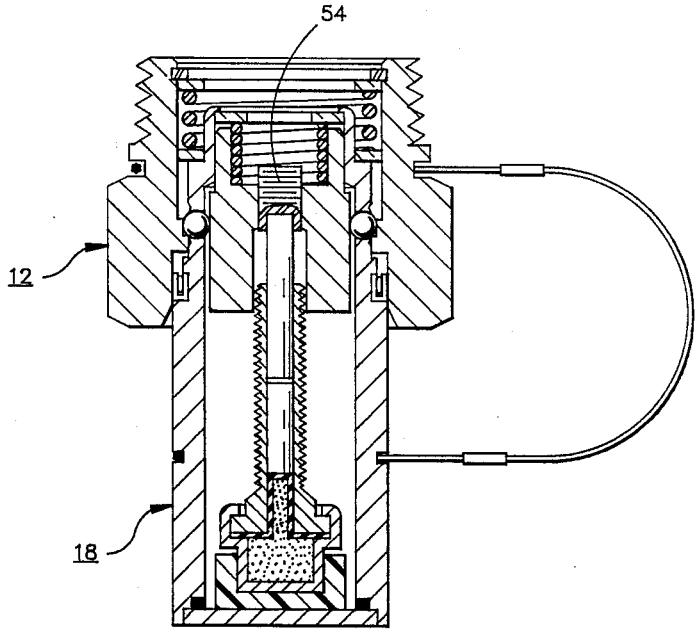

For preventive maintenance of freeze protection systems, especially those using valves triggered by thermal actuators, it is common practice to replace valves or valve components periodically and to rebuild the valves or components which are taken out of service. In railroads, for example, freeze protection devices are replaced routinely as winter approaches. Normally, replacement of a freeze protection device requires draining and refilling the entire coolant system. By virtue of its bayonet action, plug 18 can be removed and replaced rapidly, without the need for tools, and with very little loss of water. However the need for draining and refilling can be avoided altogether with this invention, because the plug 18 and the bushing 12 can be removed, while still attached to each other, as shown in FIG. 3, so that disc 88 automatically drops down to close opening 82 of ring 76. This shuts off flow of water from the protected system and allows replacement of the plug an bushing assembly with a new plug and bushing assembly with very little loss of water. The disc 88 is automatically raised away from opening 82 by spider 80 when the replacement plug an bushing assembly is threaded into neck 14 of the T fitting.

When the plug is removed from the bushing as in FIG. 2, and also when the plug and bushing are removed from the T fitting while still connected together as in FIG. 3, the adjusting screw 54 is accessible by an Allen wrench or other adjusting device for fine adjustment of the triggering temperature. A small quantity of adhesive can be applied to the threads of screw 54 after calibration.

Because wax-filled thermal actuators occasionally fail unexpectedly, it is desirable in instances where freeze protection is critical to provide redundant protection. This can be done, of course, by installing multiple freeze protection devices. The embodiment shown in FIG. 4, however affords an equally effective and much less expensive solution.

Figure 4:
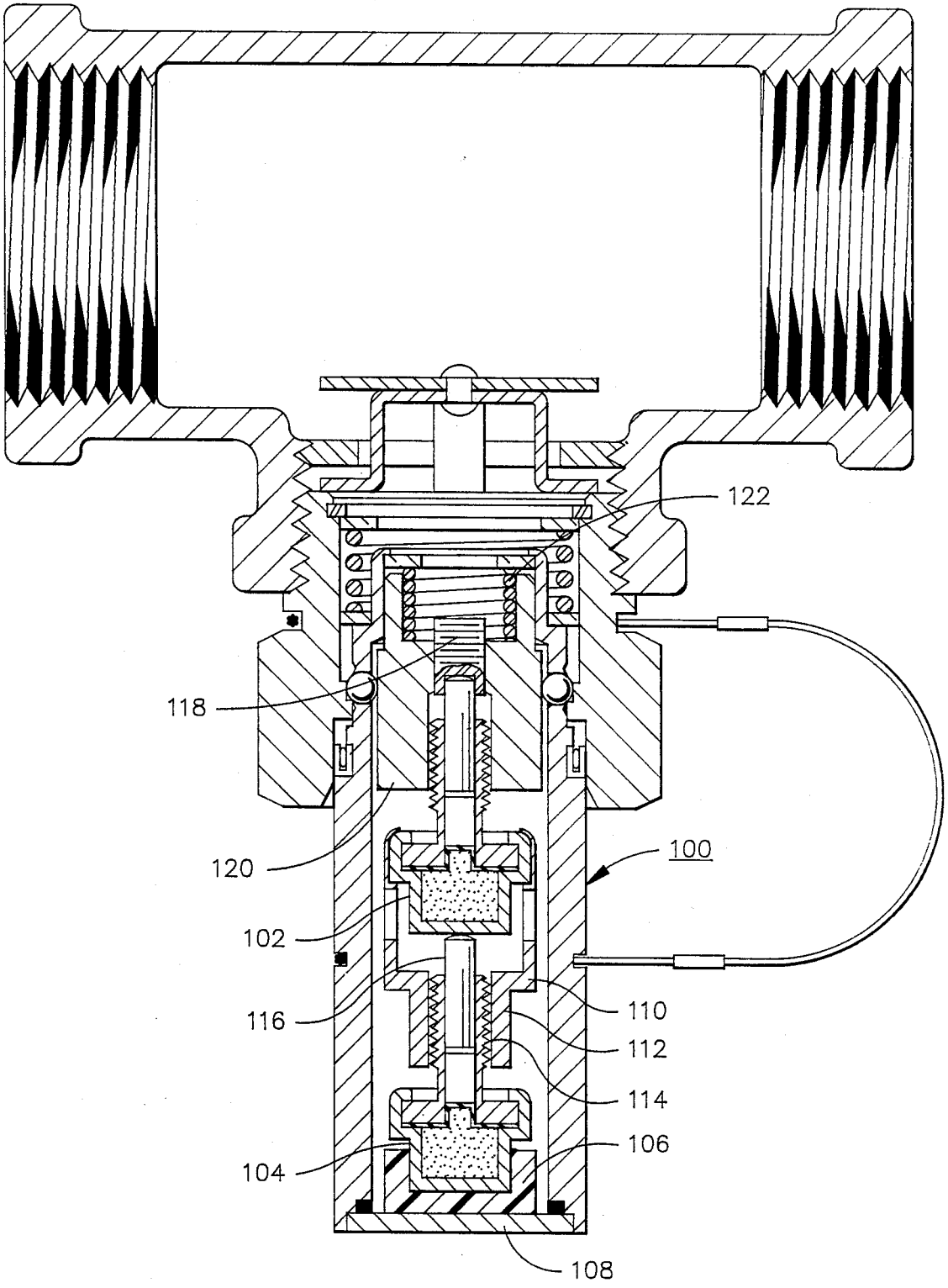
FIG. 4 is a vertical section similar to FIG. 1 but in which the plug has two wax-filled thermal actuators for improved reliability.

In FIG. 4, a plug 100, which is a modified version of plug 18, carries two thermal actuators 102 and 104 which are connected end-to-end in series so that movement of either actuator causes movement of cam 120.

Actuator 104 is supported in a seat 106 on disc 108. Actuator 102 is held in a carrier 110, which has a downwardly extending neck 112 slidably receiving stem 114 of the lower actuator. Piston 116 of the lower actuator 104 is in contact with the head of actuator 102, and the piston of actuator 102 is in contact with adjusting screw 118 in cam 120. Except for the fact that plug 100 contains two actuators and is longer than the single actuator plug 18 of FIGS. 1–3, the structure of FIG. 4 is substantially the same as that of FIG. 1.

To insure that proper opening will take place when freezing conditions are encountered even if one of the two actuators fails, the device of FIG. 4 is set so that its cam 120 allows the balls to move inwardly to their plug-releasing condition on movement of only one of the actuators. For example, if the travel of the piston of each actuator is 0.080 inch, the cam will move 0.160 inch if both actuators are operating, but may move only 0.080 inch if only one of the actuators is operative. The cam is preferably set, by adjustment of screw 118, so that the amount of travel required to trip the device is in the range of 0.065 to 0.070 inch. Because each actuator piston moves through its full range within a very narrow temperature range, the use of two actuators in series has very little effect on the triggering temperature.

When the objective of the device of FIG. 4 is to achieve increased reliability by redundancy, both actuators will ordinarily have the same operating temperatures. With a slight modification, the device of FIG. 4 can be made to release its plug at both the high end and the low end of a selected temperature range. To accomplish this, cam 106 is provided with a reduced diameter at a location just below the level of the latching balls, and actuators having different operating temperatures are used. For example if one of the actuators is designed to retract its piston at 34 degrees F. and the other is designed to retract its piston at 200 degrees F., at intermediate temperatures, one of the actuators will be extended and the other retracted. The cam is adjusted by screw 118 so that the portion between its reduced sections is in register with the latching balls. If the temperature falls below 34 degrees, the actuator with the extended piston will retract, causing the device to trigger by allowing the cam to be pushed downward by spring 122. If the temperature rises above 200 degrees, the actuator with the retracted piston will extend, causing the device to trigger by moving the cam upwardly.

Plugs can be readily interchanged to provide increased reliability by substituting a dual actuator plug for a single actuator plug or by substituting one plug for another to change the triggering temperature or to change the triggering temperature range.

Figure 5:
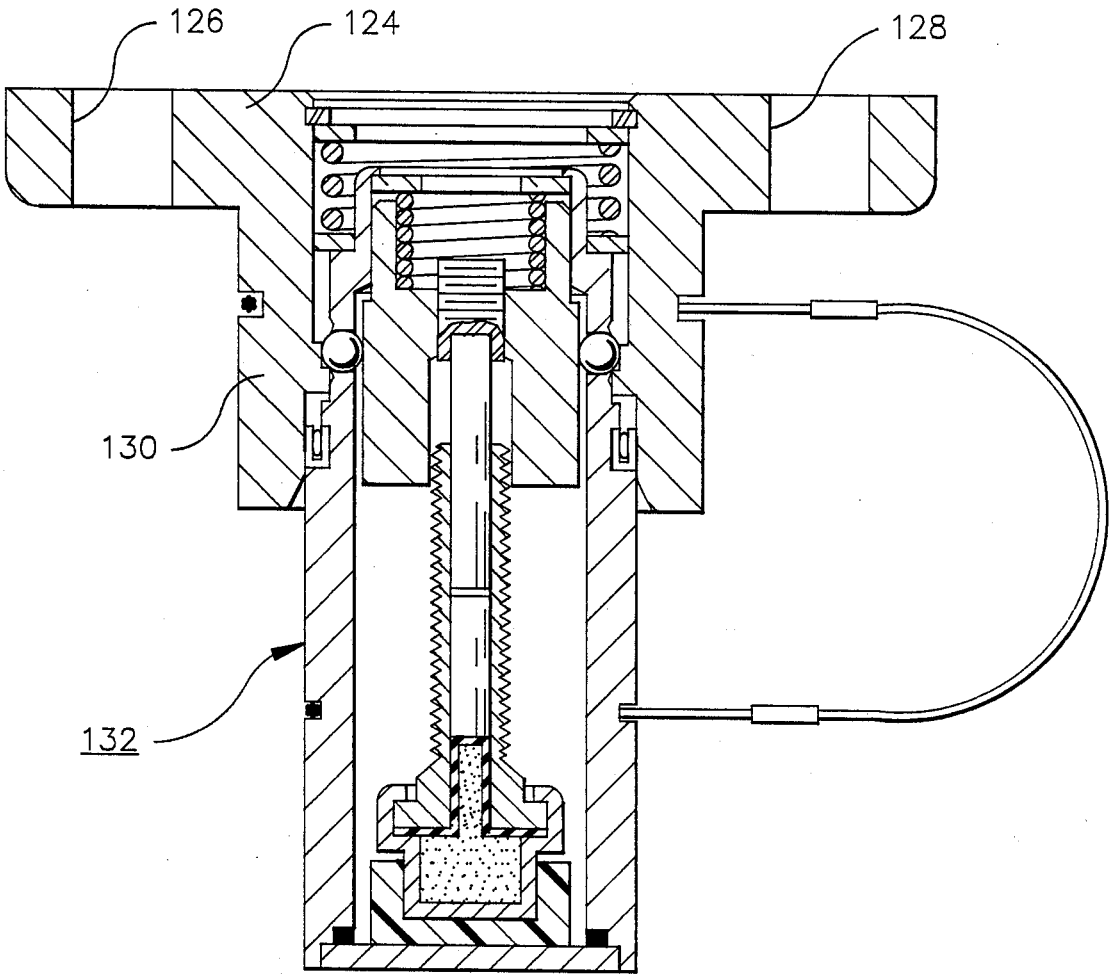
FIG. 5 is a vertical section showing a plug similar to the plug of FIG. 1 in a flange mounting suitable for attachment to a water-cooled compressor head.

FIG. 5 shows another version of the device in which the plug fits into the neck of a flanged mounting. This version is particularly suited for freeze protection of a compressor head. The mounting comprises a flange 124 having holes 126 and 128 for mounting bolts, and a neck 130, the interior of which is substantially identical to that of bushing 12 of FIG. 1. The plug 132 is substantially identical to plug 18 of FIG. 1. Thus, the only significant difference between the devices of FIGS. 1 and 5 is that the former includes a bushing threaded into a T fitting, whereas the latter has a mounting comprising a neck and a flange. The device of FIG. 5 can be substituted for the flanged freeze plug fittings conventionally used on compressor heads.

The plugs, as described with reference to FIGS. 1–5, can also be used to control valves such as the freeze-protection drain valve of FIG. 6. The plug 134 is held, bayonet-fashion, in a flanged neck 136, the interior of which is substantially identical to that of the bushing 12 of FIG. 1. The flange 138 is clamped by a threaded clamp 140 to the neck 142 of a valve body 144.

The valve body has two ports 146 and 148 for connection of the valve in a coolant line. A drain port 150 is surrounded by a valve seat 152 and closed off by a valve element 154 mounted at the lower end of a valve stem 156 and urged downwardly by spring 158, which allows a limited degree of lost motion of the valve stem relative to the valve element, and insures proper seating of the valve. The stem 156 is constantly urged in the opening direction by spring 160, which is held between ring 162, supported in the valve body, and flange 164 at the upper end of the stem. The upper end of the stem is stopped by the lower end 166 of plug 134.

In operation, when the critical temperature is reached, the piston of actuator 168 allows cam 170 to retract. The latching balls move inwardly, and the plug is released. This allows the valve stem to move upwardly by an amount sufficient to open the drain port 150. The upper surface of flange 164 engages the gasket held underneath clamp 140 to cut off flow of water through the plug opening. Thus, water flows out the drain port 150, but not through the plug opening.

Figure 6:
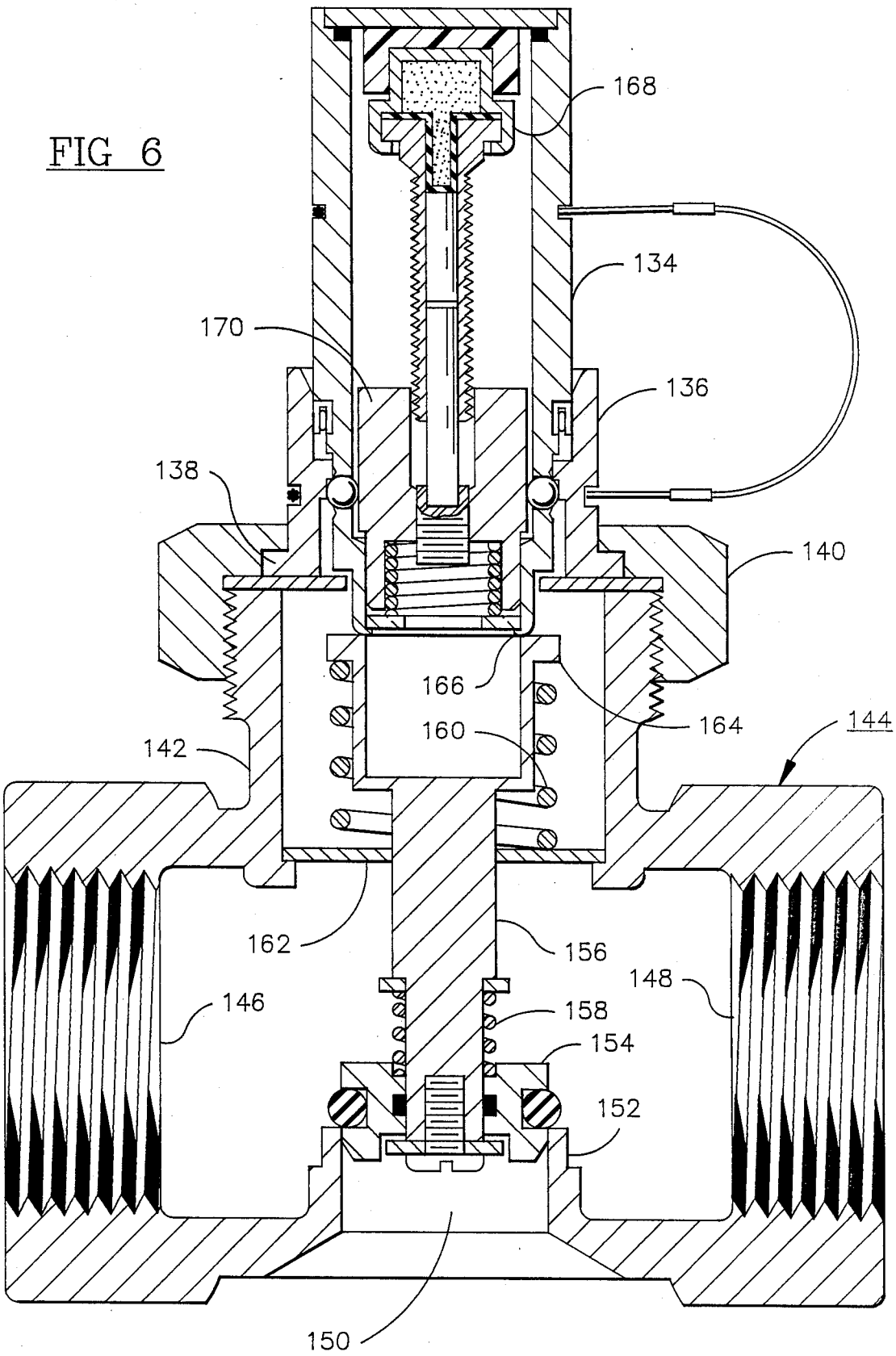
FIG. 6 is a vertical section of a snap-acting drain valve in which the valve stem of a conventional spring-loaded valve is operated by a plug of the type shown in FIG. 1.

When the device of FIG. 6 is used to protect a cooling system, the actuator is kept warm by water vapor, which reaches it through the narrow spaces between the cam and the inner wall of the plug. When the cooling system shuts down, however, the actuator cools down and is affected by outside temperatures. The operation of the valve of FIG. 6 is, in many ways, similar to the operation of the valve of my U.S. Pat. No. 4,460,007. An important advantage of the valve of FIG. 6, however, is that the plug can be easily replaced by taking advantage of its bayonet action. This makes routine maintenance much easier. It also makes it easy to change the operating temperature of the valve, as one plug can be substituted for another in a matter of a few seconds. Furthermore, if desired, a plug having redundant actuators can be substituted for one having a single actuator.

Figure 7:
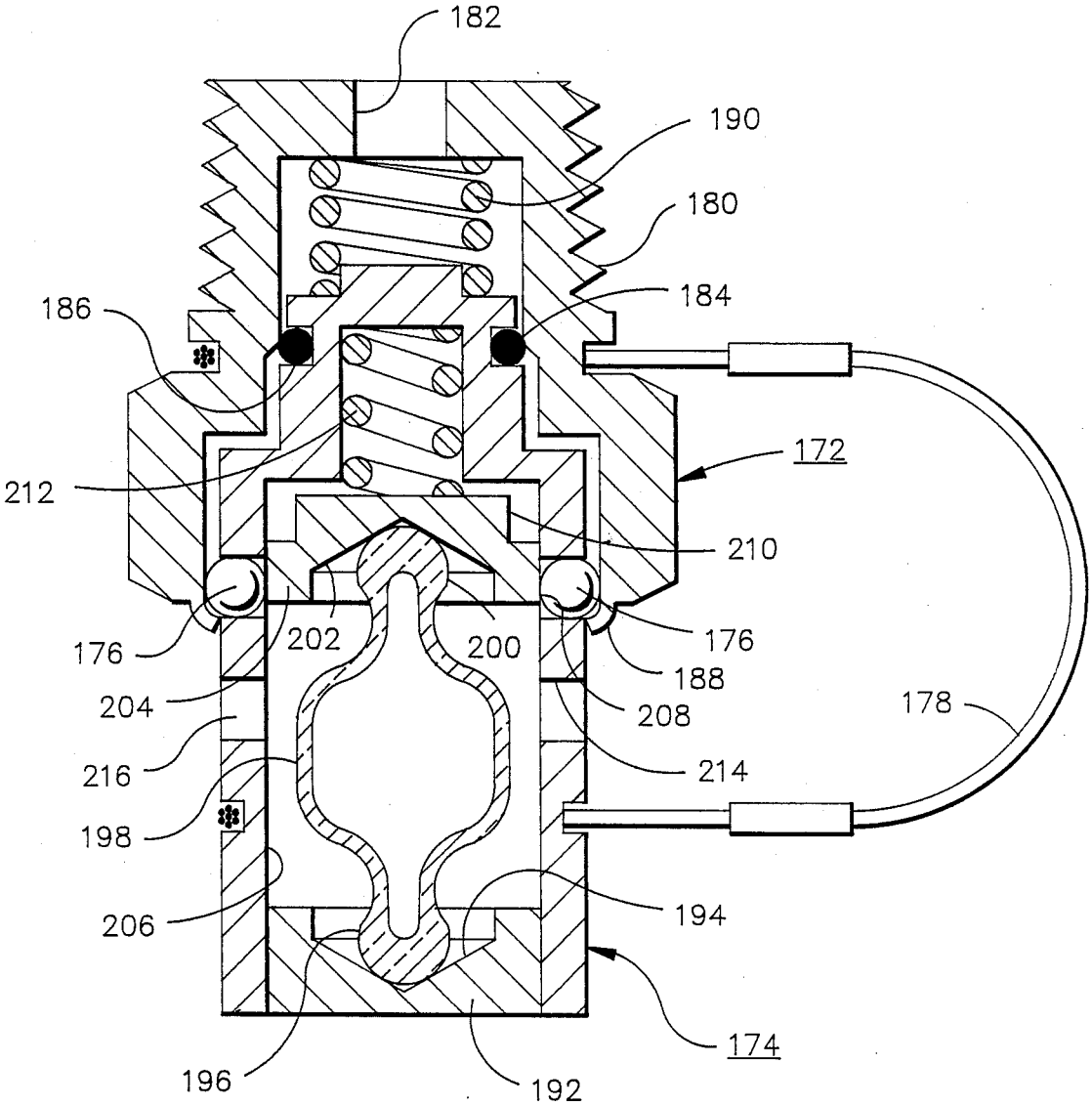
FIG. 7 is a vertical section of a plug and bushing structure in which the plug utilizes an actuator consisting of a spring-loaded, water-filled glass vial.

The freeze protection device of FIG. 7 utilizes a liquid-filled glass vial instead of a wax-filled thermal actuator. It comprises a bushing 172 and a plug 174 held in the bushing by latching balls 176, and attached to the bushing by means of a lanyard 178. The device typically uses three or more latching balls. The device of FIG. 7 uses four balls. However only two of them are shown.

The bushing has exterior threads 180, which allow it to be connected to a T fitting or to any suitable threaded drain opening. An opening 182 is provided in the bushing for the flow of water through the bushing when the plug is removed.

The plug is sealed in the bushing by an O-ring 184, which is situated in groove 186 on the exterior of the plug. Whereas in the devices of FIGS. 1–6, the seal is located on the side of the balls remote from the protected liquid system, in the case of FIG. 7, the seal is located between the balls and the liquid system. The lower opening of the bushing is crimped at 188 to provide a detent for the balls 176, which protrude through radial openings in the wall of the plug. The openings provided in plug 174 need not be staked, as the plug is not designed to be inserted into the bushing manually, but is factory-installed. Engagement of the balls with the crimped opening of the bushing prevents the plug from being pushed out of the bushing under the urging of spring 190, which is held in compression between the upper end of the plug and the inside of the upper end of the bushing.

The lower end of the plug is closed by a fitting 192, which is held in place either by a press fit or by crimping the lower end of the plug. This fitting has a cone-shaped recess 194 which receives and centers the lower end 196 of a glass vial 198. The upper end 200 of the vial is received and centered in a similar conical recess 202 in a cam 204 which is adapted to slide along the cylindrical interior wall 206 of the plug. The cam has a large diameter cylindrical outer wall section 208, which slides along wall 206 and is normally in register with the latching balls 176. Above the balls, the cam is stepped inwardly to provide a smaller diameter cylindrical outer wall section 210. When wall section 210 is brought into register with the balls, the balls move inwardly, clear the crimped lower end of the bushing, and allow the plug to be pushed out of the bushing by spring 190.

Cam 204 is urged downwardly by coil spring 212 within the plug, but retained by the glass vial 198 while the vial is intact. In operation, when the glass vial fractures as a result of freezing of the liquid within it, spring 212 moves cam 204 downwardly, the balls move inwardly, and the plug is pushed out of the bushing.

The glass vial can be filled with any desired liquid, but in most applications, it is filled with water and sealed at its upper and lower ends by a cement such as an epoxy cement, or by fusing the glass. For reliable performance, and to insure that triggering occurs exactly at the freezing temperature, high purity water should be used, and the vial should be completely filled so that there is little or no air space. Complete filling can be assured by the use of a vacuum pump to eliminate any trapped or dissolved air which could produce bubbles within the vial during or after sealing.

To insure reliable operation, the exterior of the glass vial should be treated by sand blasting. Sand blasting promotes rupture of the vial as soon as the water within it begins to freeze. Experiments have shown that, when high purity water is used, air is eliminated by vacuum pumping, and the vial is sand blasted, triggering occurs consistently within an extremely narrow temperature range at the freezing point of water.

Since the glass vial will also rupture when the water within it boils, the device of FIG. 7 will operate both at freezing and at boiling temperatures. Thus, it may not be suitable for use in coolant systems where temperatures exceed boiling.

The device of FIG. 7 conducts heat from the liquid system to the glass vial (and from the glass vial to the liquid system) through its metal parts. Thus, the device is responsive, at least in part, to the temperature of the liquid system. Vent holes may be provided in the body of the plug at 214 and 216 to increase the sensitivity of the device to changes in ambient temperatures.

Figure 8:
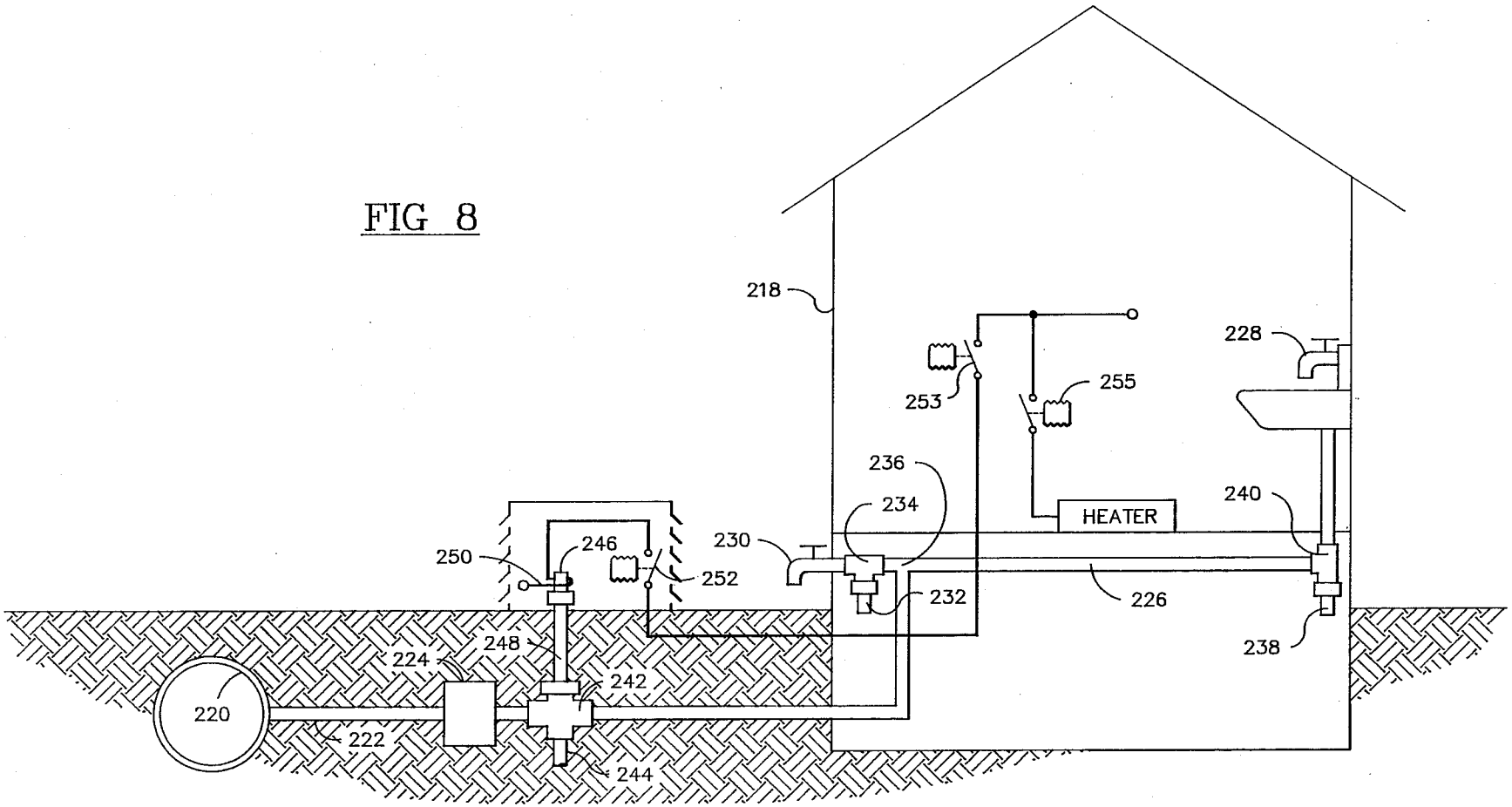
FIG. 8 is a schematic diagram showing how several freeze protection devices in accordance with the invention can be used to protect the water supply system of a building.

FIG. 8 illustrates a typical application of the freeze protection devices of the invention in a building. Building 218 supplied with water from a water main 220 through a buried pipe 222 and a meter 224. Pipe 222 is located below the frost line so that it cannot freeze. Inside the building, pipe 222 is connected to a pipe 226, which leads to an inside faucet 228 and to an outside faucet 230. A freeze protection device 232, preferably of the type illustrated in FIG. 7, is connected to the neck of a T fitting 234 between pipe junction 236 and faucet 230. A similar freeze protection device 238 is connected to one of the ports of T fitting 240 in the connection between pipe 226 and faucet 228. Downstream of water meter 224, a three-way valve 242 is connected in pipe 222. This three-way valve normally allows flow of water from the main into the building, but can be shifted to a condition in which it blocks the flow from the main into the building and allows water to drain from the building into the ground through drain outlet 244. Valve 242 is controlled by a plug 246 through a long stem 247 extending through an elongated tubular neck 248, as shown in FIG. 11. Plug 246 can be of the wax-filled thermal actuator type as shown in FIG. 11, or can be of another type such as the glass vial type shown in FIG. 7. A coil spring 251 (FIG. 11) urges stem 247 upwardly. However, plug 246 normally holds the stem in its downward position, as shown, so that valve 242 conducts water from port 257 to port 259 and closes off flow through drain outlet 244.

Returning to FIG. 8, plug 246 is provided with an electrical heat trace 250 controlled by a thermostat 252. The thermostat applies electric current to the heat trace to prevent plug 246 from freezing when the outdoor temperature falls. The heat trace is powered, through exterior thermostat 252 and interior thermostat 253, from the same electrical supply which operates the controls for the building's heating system. The building's heater is controlled through thermostat 255.

In the operation of the system of FIG. 8, if the outdoor temperature is below freezing, but the building interior is heated, the circuit to the heat trace is completed through the two thermostats, and valve 242 is able to supply water to the building. If the outdoor temperature rises above freezing, thermostat 252 shuts off current to the heat trace, as it is unnecessary.

If the electrical power for the building's heater controls fails, then no power is delivered to the heat trace. Therefore, if the outdoor temperature falls while power is shut off, valve 242 will shut off flow of water to the building and open the portion of pipe 222 between valve 242 and the building. Then, if the temperature within the building falls below freezing, one or more of the interior freeze protection devices 232 and 238 will open. This allows the interior water system to drain partially through devices 232 and 238, and breaks the vacuum in the interior pipe system so that further drainage occurs through pipe 222 and valve 242. The same thing occurs if the building's heating system fails for reasons other than electrical failure, because thermostat 253 will shut off electrical power to the heat trace if the interior temperature falls below a predetermined level.

Figure 10:
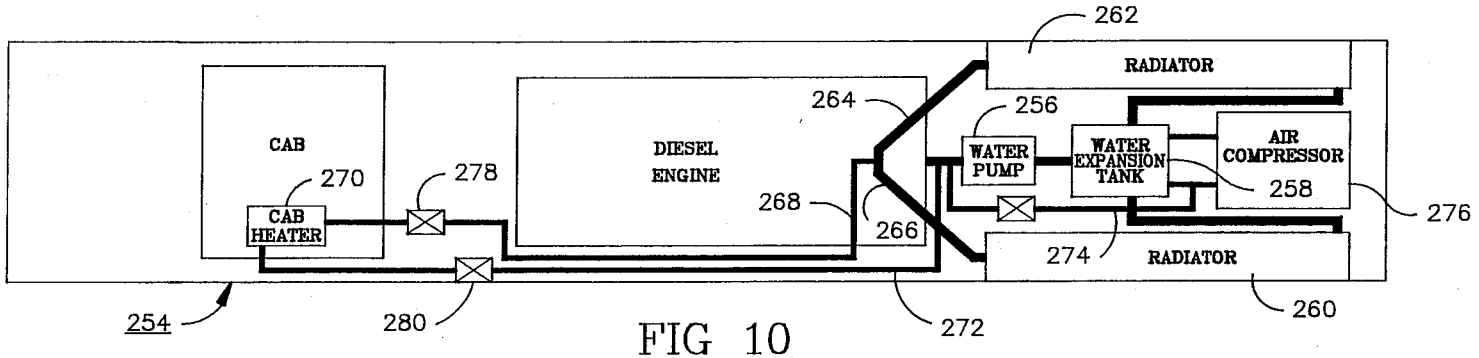
FIG. 10 is a schematic top plan view of the locomotive of FIG. 9.
Figure 9:
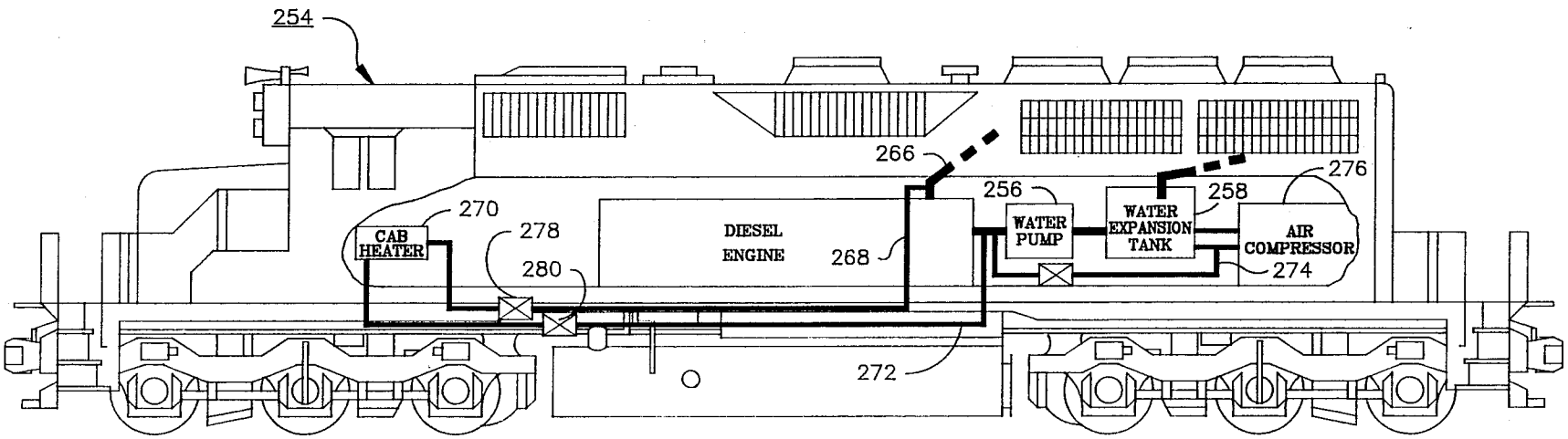
FIG. 9 is a schematic elevational view of a diesel locomotive showing the locations of several freeze protection devices in accordance with the invention.

As shown in FIGS. 9 and 10 a typical Diesel railroad locomotive 254 has a cooling system in which water is pumped by means of a pump 256 from the engine block through a water expansion tank 258 into radiators 260 and 262. Water is returned from the radiators to the engine through lines 264 and 266, and a portion of the returned water is tapped off by line 268 and delivered to cab heater 270. Water is returned from the cab heater to the water pump 256 through line 272. A water by-pass line 274 leads from the intake side of the water pump to one of two air compressor cooling water lines leading from the water expansion tank to air compressor 276.

Freeze protection devices of the type shown in FIG. 1 are provided at 278 and 280 in the cab heater lines 268 and 272. Another similar freeze protection device is provided in the by-pass line 274. When freezing conditions occur with the engine shut down, these three freeze protection devices insure that all of the cooling water will be drained from the engine.

Additional freeze protection devices may be provided in the radiator return lines 264 and 266 for faster draining. Each air compressor head may also be provided with one or more freeze protection devices, preferably of the type shown in FIG. 5.

Air compressor heads build up with water-containing sludge, which can freeze and damage the heads even though the rest of the locomotive cooling system is completely drained. The use of freeze protection devices according to the invention directly on the compressor heads has two advantages. First, it allows water pressure within the cooling system to flush out sludge before it freezes. Secondly, it opens the water spaces within the compressor heads in the same manner as a conventional freeze plug, but does so before freezing of the accumulated sludge takes place, thereby eliminating damage due to the build-up of pressure during freezing.

As will be apparent from the foregoing, the invention has numerous advantages over prior freeze protection devices, and in particular, the advantages of easy resetting, versatility, simplicity, reliability and ease of replacement.

Many modifications can be made to the invention disclosed. For example, bellows-type actuators, or other types of actuators can be substituted for the wax-filled thermal actuators shown. Furthermore, the devices can be made to operate upon a drop in temperature, or upon a rise in temperature, or both, by simple modification of the configuration of the latching cam. Numerous other modifications can be made without departing from the scope of the invention as defined in the following claims.

I claim:

1. In a water supply system for a building wherein water is supplied to the building from a water main through a buried pipe, a protective system comprising:

valve means in the buried pipe shiftable from a first position in which it permits flow of water from the main into the building to a second position in which it shuts off flow of water from the main and allows water to drain out of the building through the buried pipe;

temperature-responsive means arranged to control the valve means and to shift the valve means to its second position when the temperature sensed by the temperature-responsive means falls below a first predetermined level;

electrical heat trace means located in proximity to said temperature-responsive means to maintain the temperature-responsive means at a temperature above said first predetermined level when energized;

at least one temperature-responsive drain means within the building, for draining at least part of the water system within the building when the temperature within the building falls below a second predetermined level;

first thermostat means responsive to outdoor ambient temperature;

second thermostat means responsive to temperature within the building; and means connecting the first and second thermostat means to control energization of the heat trace means so that the heat trace means is energized when the outdoor ambient temperature is below a third predetermined level and the temperature within the building is above a fourth predetermined level and so that the heat trace means is otherwise deenergized.

2. A protective system according to claim 1 in which the building is heated by an electrically controlled heating system, and including means for shutting off electrical power to the heat trace means when the electrical power which controls the heating system fails.

* * * * *